US009576783B2

(12) United States Patent
Köster

(10) Patent No.: US 9,576,783 B2
(45) Date of Patent: Feb. 21, 2017

(54) TIME-OF-FLIGHT MASS SPECTROMETERS WITH CASSINI REFLECTOR

(71) Applicant: Bruker Daltonik GmbH, Bremen (DE)

(72) Inventor: Claus Köster, Lilienthal (DE)

( * ) Notice: Subject to any disclaimer, the term of this patent is extended or adjusted under 35 U.S.C. 154(b) by 0 days.

(21) Appl. No.: 14/903,404

(22) PCT Filed: Jul. 8, 2014

(86) PCT No.: PCT/EP2014/001872
§ 371 (c)(1),
(2) Date: Jan. 7, 2016

(87) PCT Pub. No.: WO2015/003799
PCT Pub. Date: Jan. 15, 2015

(65) Prior Publication Data

US 2016/0148795 A1 May 26, 2016

(30) Foreign Application Priority Data

Jul. 10, 2013 (DE) ..... 10 2013 011 462

(51) Int. Cl.
*H01J 49/40* (2006.01)
*H01J 49/42* (2006.01)

(52) U.S. Cl.
CPC ..... *H01J 49/405* (2013.01); *H01J 49/425* (2013.01)

(58) Field of Classification Search
USPC ..... 250/287, 290, 291, 292
See application file for complete search history.

(56) References Cited

U.S. PATENT DOCUMENTS 7,994,473 B2 8/2011 Koster
8,735,812 B2 5/2014 Koster
(Continued)

FOREIGN PATENT DOCUMENTS

DE 102007024858 A1 10/2008
DE 102011008713 A1 7/2012

OTHER PUBLICATIONS

Köster, Claus et al., The concept of electrostatic non-orbital harmonic ion trapping, International Journal of Mass Spectrometry, Oct. 15, 2009, pp. 114-118, vol. 287, No. 1-3, Elsevier Science Publishers, Amsterdam, NL.

*Primary Examiner* — Kiet T Nguyen
(74) *Attorney, Agent, or Firm* — Benoit & Cote, Inc.; Philip L. Conrad

(57) ABSTRACT

The invention relates to embodiments of high-resolution time-of-flight (TOF) mass spectrometers with special reflectors. The invention provides reflectors with ideal energy and solid angle focusing, based on Cassini ion traps, and proposes that a section of the flight path of the TOF mass spectrometers takes the form of a Cassini reflector. It is particularly favorable to make the ions fly through this Cassini reflector in a TOF mass spectrometer at relatively low energies, with kinetic energies of below one or two kiloelectronvolts. This results in a long, mass-dispersive passage time in addition to the time of flight of the other flight paths, without increasing the energy spread, angular spread or temporal distribution width of ions of the same mass. It is also possible to place several Cassini reflectors in series in order to extend the mass-dispersive time of flight. Several TOF mass spectrometers for axial as well as orthogonal ion injection with Cassini reflectors are presented.

11 Claims, 7 Drawing Sheets

(56) References Cited

U.S. PATENT DOCUMENTS

| | | | | |
|---|---|---|---|---|
| 2009/0294656 | A1* | 12/2009 | Koster | H01J 49/0045 250/283 |
| 2012/0138785 | A1 | 6/2012 | Makarov et al. | |
| 2012/0181423 | A1 | 7/2012 | Köster | |
| 2015/0371840 | A1* | 12/2015 | Park | H01J 49/063 250/396 R |

* cited by examiner

TIME-OF-FLIGHT MASS SPECTROMETERS WITH CASSINI REFLECTOR

FIELD OF INVENTION

The invention relates to time-of-flight mass spectrometers with specially shaped reflectors.

BACKGROUND

In the prior art, there are essentially two types of high-resolution reflector time-of-flight mass spectrometers, which are characterized according to the way the ions are injected.

Time-of-flight mass spectrometers with axial injection include MALDI time-of-flight mass spectrometers (MALDI-TOF MS), which operate with ionization by matrix-assisted laser desorption, but also time-of-flight mass spectrometers where stored ions are injected axially into the flight path from a storage device such as an RF quadrupole ion trap. They usually have Mamyrin reflectors (B. A. Mamyrin et al., "The mass-reflectron, a new nonmagnetic time-of-flight mass spectrometer with high resolution", Sov. Phys.-JETP, 1973: 37(1), 45-48) in order to temporally focus ions with an energy spread. Mamyrin reflectors allow second-order temporal focusing, but not higher order focusing. Since point ion sources are used, the reflectors can be gridless, as a modification of the Mamyrin reflectors, which are operated with grids. MALDI-TOF MS are operated with a delayed acceleration of the ions in the adiabatically expanding laser plasma and with high accelerating voltages of up to 30 kilovolts; in good embodiments, with a total flight path of around 2.5 meters, they achieve mass resolving powers of R=50 000 in a mass range of around 1000 to 3000 daltons.

Figure 1:
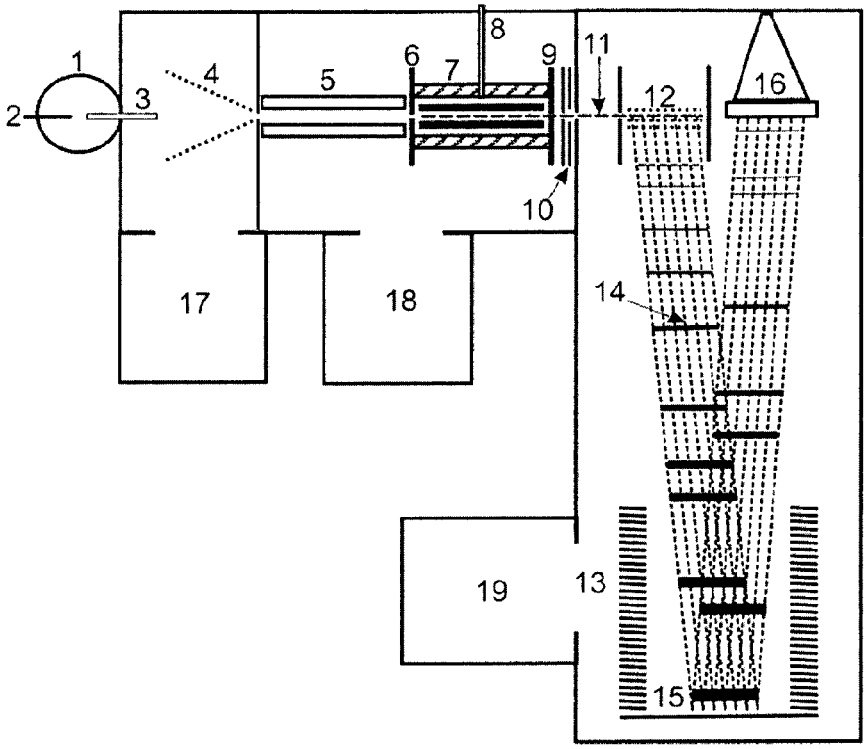
Figure 1 (Prior Art)

Time-of-flight mass spectrometers where a primary ion beam undergoes pulsed acceleration at right angles to the original direction of flight of the ions are termed OTOF-MS (orthogonal time-of-flight mass spectrometers). FIG. 1 depicts a simplified schematic of such an OTOF-MS. The mass analyzer of the OTOF-MS has a so-called ion pulser (12) at the beginning of the flight path (13), and this ion pulser accelerates a section of the low-energy primary ion beam (11), i.e. a string-shaped ion packet, into the flight path (13) at right angles to the previous direction of the beam. The usual accelerating voltages, only small fractions of which are switched at the pulser, amount to between 8 and 20 kilovolts. This forms a ribbon-shaped secondary ion beam (14), which consists of individual, transverse, string-shaped ion packets, each of which is comprised of ions having the same mass. The string-shaped ion packets with light ions fly quickly; those with heavier ions fly more slowly. The direction of flight of this ribbon-shaped secondary ion beam (14) is between the previous direction of the primary ion beam and the direction of acceleration at right angles to this, because the ions retain their speed in the original direction of the primary ion beam (11). A time-of-flight mass spectrometer of this type is also preferably operated with a Mamyrin energy-focusing reflector (15), which reflects the whole width of the ribbon-shaped secondary ion beam (14) with the string-shaped ion packets, focuses its energy spread, and directs it toward a flat detector (16). The width of the ion beam means the reflector must be operated with grids. Mass resolving powers of around R=40 000 at mass 1000 daltons are achieved in these OTOF mass spectrometers.

As these two examples suggest, time-of-flight mass spectrometers with high mass resolution are operated predominantly with Mamyrin reflectors in today's technology. Mamyrin reflectors provide second-order energy focusing, but not higher order focusing. If the energy spread of the ions is relatively large compared to the average energy, undesirable focusing errors occur. Since the kinetic energy of the ions always spreads slightly as the ions are being produced, or during their pulsed acceleration, the time-of-flight mass spectrometers must be operated with high accelerating voltages for the ions, between 5 and 30 kilovolts, for example, in order to always keep the relative energy spread as small as possible in relation to the average energy.

As a consequence of the high ion energy, the very long flight paths must be chosen in order to achieve a good temporal dispersion of ions of different masses. Since the fastest ion detectors at present offer measurement rates up to five billion measurements per second, and thus require a separation of a few nanoseconds between two ion masses which are to be resolved, the flight paths for the high mass resolutions desired must be several meters long, often far more than ten meters. If multiple reflectors are used to keep the instrument compact and to extend the flight path, the residual errors of the reflectors add up. If lower accelerating voltages are used in order to manage with shorter flight paths, the resulting higher relative energy spread, which cannot be focused in a higher order, prevents a high resolving power from being achieved.

It is known that a quadratically increasing electric potential in the reflector results in an ideal reflection with energy focusing of as high an order as desired (T. J. Cornish et al., "A curved field reflectron time-of-flight mass spectrometer for the simultaneous focusing of metastable product ions", Rapid Commun. Mass Spectrom., 1994: 8(9), 781-785). If such a field is generated in a simple diaphragm stack by voltages which increase quadratically from aperture to aperture, the result is a defocusing effect in both lateral directions. If the kinetic energy of the ions is decreased in order to achieve long dispersive times of flight, the laterally defocusing effect increases. Further electric fields for at least "quasi-ideal" energy focusing are presented in a publication by A. A. Makarov, J. Phys. D; Appl. Phys. 24, 533 (1991).

Kingdon ion traps are generally electrostatic ion traps in which ions can orbit one or more inner electrodes or oscillate between several inner electrodes. An outer, enclosing housing is at a DC potential which the ions with a predetermined total energy (sum of kinetic and potential energy) cannot reach. In special Kingdon ion traps which are suitable for use as mass spectrometers, the inner surfaces of the housing electrodes and the outer surfaces of the inner electrodes can be designed in such a way that, firstly, the motions of the ions in the longitudinal direction of the Kingdon ion trap are completely decoupled from their motions in the transverse direction and, secondly, a symmetrical, parabolic potential profile is generated in the longitudinal direction in which the ions can oscillate harmonically in the longitudinal direction. When "Kingdon ion traps" are mentioned below, this always refers to these special designs.

In the publications DE 10 2007 024 858 A1 (C. Köster) and DE 10 2011 008 713 A1 (C. Köster), Cassini ion traps are described as special types of Kingdon ion traps which differ in the way in which several inner electrodes are arranged. The inner electrodes and the outer housing electrode (and possibly several segmented housing electrodes also) are designed here in such a way that the longitudinal motion is completely decoupled from the transverse motion, and a parabolic potential well is generated in the longitudinal direction for a harmonic oscillation.

The potential distribution $\phi(x,y,z)$ of such a Cassini ion trap can, for example, be that of a hyperlogarithmic field of the following form:

$$\psi(x, y, z) = \ln\left[\frac{(x^2+y^2)^2 - 2\cdot b^2\cdot(x^2-y^2)+b^4}{a^4}\right]\cdot \frac{U_{ln}}{C_{ln}} + [-(1-B)\cdot x^2 - B\cdot y^2 + z^2]\cdot\frac{U_{quad}}{C_{quad}} + U_{off}$$

The shape of the field can be changed by the constants a, b and B. $U_{ln}$, $U_{quad}$ and $U_{off}$ are potential voltages. The inner surface of the outer housing and the outer surfaces of the inner electrodes are equipotential surfaces $\phi(x,y,z)$=const. of this potential distribution. In cross-section, the equipotential lines form approximate Cassini ovals about the inner electrodes here; two inner electrodes result in Cassini ovals of the second order, while n inner electrodes result in Cassini ovals of the nth order. For an even number of inner electrodes, there are embodiments where the ions can oscillate transversely near the center plane between at least one pair of inner electrodes. Any ratio of the longitudinal oscillation period to the transverse oscillation period can be set with the aid of form parameters.

In view of the foregoing, there is a need to provide compact time-of-flight mass spectrometers with high mass resolution, and especially to provide reflectors for time-of-flight mass spectrometers whose energy and solid angle focusing are as ideal as possible.

BRIEF SUMMARY OF THE INVENTION

The present invention provides a time-of-flight mass spectrometer with an ion source, a flight path and an ion detector, wherein at least a section of the flight path of the time-of-flight mass spectrometer has a potential distribution of a Cassini ion trap with several inner electrodes, preferably an even number of electrodes, the Cassini ion trap being shaped for decoupled oscillations of the ions in the longitudinal and the lateral directions.

A time-of-flight mass spectrometer according to the invention preferably has at least one field-free section of the flight path and at least one reflector with the potential distribution of a Cassini ion trap with several inner electrodes shaped for decoupled oscillations of the ions in the longitudinal and the lateral directions. The at least one reflector can, for example, comprise a halved Cassini ion trap with a housing, two inner electrodes and a terminating equipotential plate with electrodes, where the electrodes of the equipotential plate trace the equipotential surfaces of the potential distribution of the Cassini ion trap at the location of the equipotential plate. The equipotential plate here has apertures for the injection and ejection of ions, while the shape of the reflector and the positions of the injection and ejection apertures are preferably designed so that ions with the same mass pass through an odd whole number of transverse half oscillations in the reflector. The housing of a Cassini reflector can also be constructed as a stack of apertured diaphragms, especially of identically shaped apertured diaphragms, connected to a voltage supply which generates a potential that increases quadratically from diaphragm to diaphragm.

In a time-of-flight mass spectrometer according to the invention, a greater part of the flight path of the time-of-flight mass spectrometer can have a potential distribution of a Cassini ion trap with several inner electrodes, the Cassini trap shaped for decoupled oscillations of the ions in the longitudinal and the lateral directions, i.e. ions experience a potential distribution of a Cassini ion trap over more than half of the flight path in the time-of-flight mass spectrometer (or in the mass-dispersive section of the time-of-flight mass spectrometer). This greater part preferably comprises one or more halved Cassini ion traps, each having two inner electrodes and at least one terminating equipotential plate.

A time-of-flight mass spectrometer according to the invention can have at least one diaphragm system (acceleration and/or deceleration unit for ions), which shapes the kinetic energy of the ions in such a way that the ions pass through the Cassini reflector, or through the flight path with the potential distribution of a Cassini ion trap, with a kinetic energy of around ten kiloelectronvolts at most, preferably less than two kiloelectronvolts, in particular less than one kiloelectronvolt. Furthermore, the time-of-flight mass spectrometer may include an RF quadrupole ion trap or a puller for the orthogonal injection of an ion beam. The ion source of the time-of-flight mass spectrometer can be a MALDI ion source, for example, but electrospray ion sources or other types of ionization, especially in combination with orthogonal injection, are also possible. The ion detector is preferably an ion detector with a secondary electron multiplier, but can also be a Faraday detector. The ion detector here is arranged in such a way with respect to the flight path of the ions that the ions are destroyed on arrival at the ion detector. In particular, the exit of a Cassini reflector can be equipped with an ion acceleration system with a conversion plate for converting ions into electrons, which then fly backwards through the Cassini reflector; and a secondary electron multiplier which detects the electrons is mounted behind an equipotential plate at the rear.

The invention provides reflectors with ideal focusing, which are based on Cassini ion traps, and proposes that a section of the flight path of a time-of-flight mass spectrometer takes the form of a Cassini reflector. Cassini reflectors can focus ions of the same mass in an ideal way according to energy as well as solid angle of injection. It is particularly favorable to make the ions fly through this Cassini reflector in a time-of-flight mass spectrometer at relatively low energies, with kinetic energies of below one or two kiloelectronvolts. This results in a long mass-dispersive passage time in addition to the time of flight of the other flight paths, without increasing the energy spread, angular spread or temporal distribution width of ions of the same mass. It is also possible to place several Cassini reflectors in series in order to extend the mass-dispersive time of flight. The voltages at the electrodes (apertured diaphragms or electrodes shaped according to the potential distribution) of a Cassini reflector or a Cassini flight path can be provided by one or more capacitors or by several electro-chemical batteries (especially rechargeable batteries).

BRIEF DESCRIPTION OF THE ILLUSTRATIONS

FIG. 1 shows a schematically simplified representation of a time-of-flight mass spectrometer which corresponds to the prior art. Ions are generated at atmospheric pressure in an ion source (1) with a spray capillary (2), and these ions are introduced into the vacuum system through a capillary (3). A conventional RF ion funnel (4) guides the ions into a first RF quadrupole rod system (5), which can be operated as a simple ion guide, but also as a mass filter for selecting a species of parent ion to be fragmented. The unselected or selected ions are fed continuously through the ring diaphragm (6) and into the storage device (7); selected parent ions can be fragmented in this process by energetic collisions. The storage device (7) has a gastight casing and is charged with collision gas through the gas feeder (8) in order to focus the ions by means of collisions and to collect them in the axis. Ions are extracted from the storage device (7) through the switchable extraction lens (9); this lens together with the einzel lens (10) shapes the ions to a fine primary beam (11) and sends them to the ion pulser (12). The ion pulser (12) pulses out a section of the primary ion beam (11) orthogonally into the high-potential drift region (13), which is the mass-dispersive region of the time-of-flight mass spectrometer, thus generating the new ion beam (14). The ion beam (14) is reflected in the reflector (15) with second-order energy focusing, and measured in the detector (16). The mass spectrometer is evacuated by the pumps (17), (18) and (19).

Figure 2:
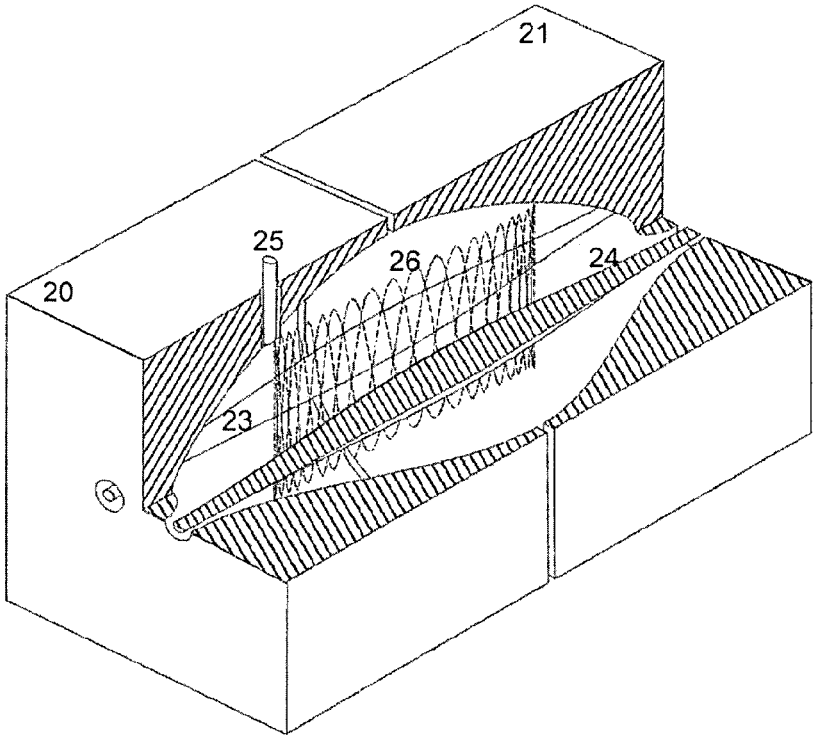
Figure 2 (Prior Art)

FIG. 2 shows a three-dimensional representation of an electrostatic Kingdon ion trap of the Cassini type, according to C. Köster, with a housing electrode which is transversely split in the center into two half-shells (20 and 21) and two spindle-shaped inner electrodes (23, 24). The Kingdon ion trap can be filled with ions through an entrance tube (25); the ions then move on oscillational paths (26). This Kingdon ion trap also corresponds to the prior art.

Figure 3:
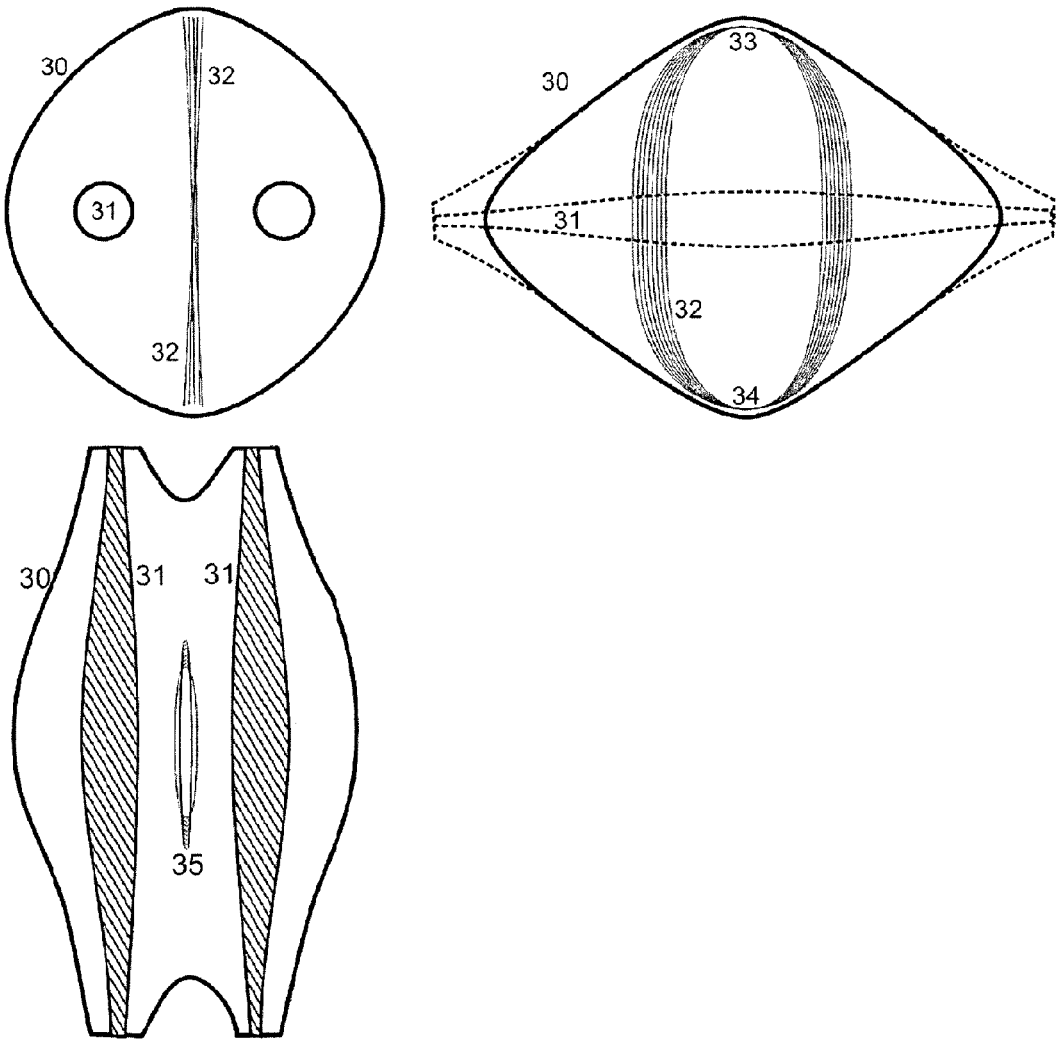

FIG. 3 is a schematic representation of three cross-sections through a Cassini ion trap whose outer housing (30) and inner electrodes (31) are designed so that the oscillation periods in the lateral direction and in the longitudinal direction are equal. The ions can therefore fly along simple, closed trajectories (32, 33) and be ideally focused according to energy and solid angle in both the upper and the lower summit.

Figure 4:
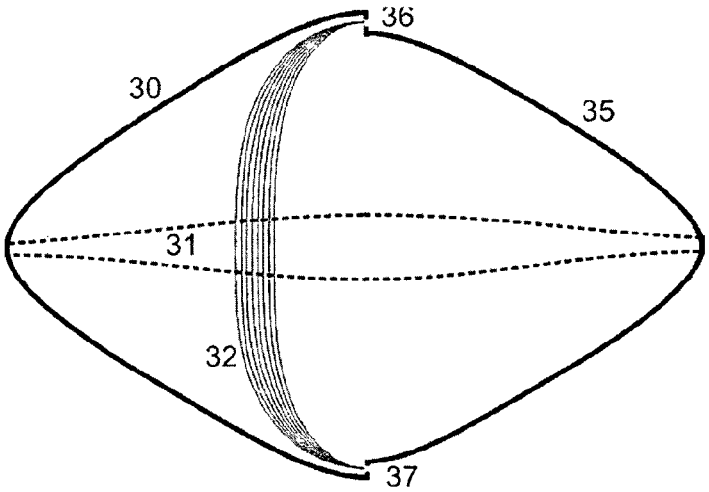

FIG. 4 depicts a Cassini ion trap according to FIG. 3, which can be used according to the invention as a reflector. The right half of the housing (35) is slightly smaller than the left half, and is also supplied with a slightly lower voltage difference to the inner electrodes (31) so that the electric fields in the interior of the Kingdon ion trap are maintained. If ions are injected at the injection point (36) with a suitable average energy, but with both solid angle spread and energy spread, they are transferred to the exit point (37) and ideally focused in the process in terms of both solid angle and energy, and not just in second order.

Figure 5:
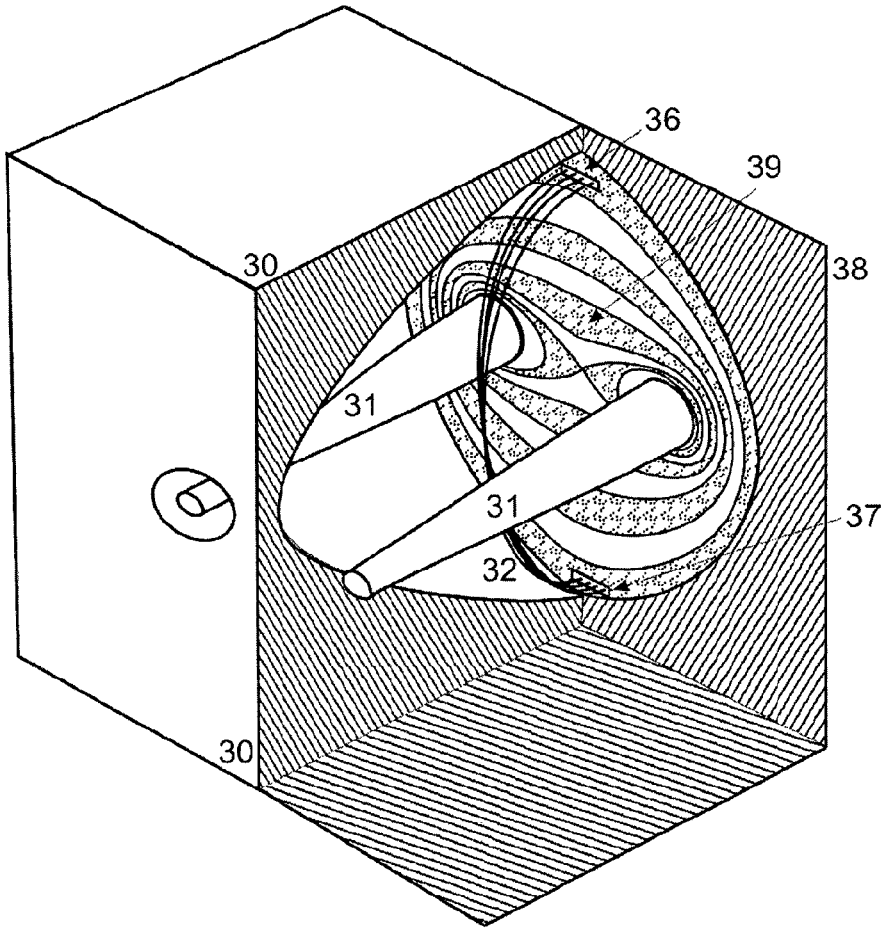

FIG. 5 provides a view into the interior of a Cassini reflector in the form of half a Cassini ion trap with housing (30) and two inner electrodes (31). The Cassini reflector here is terminated by an equipotential plate (38), which carries line-shaped electrodes (39) applied to the interior of the Cassini reflector, which follow the corresponding equipotential lines of the Kingdon ion trap and are supplied with voltages in such a way that the original electric field of the Kingdon ion trap from FIG. 3 is restored. The line-shaped electrodes (39) applied to the equipotential plate (38) are shown here only in a rough schematic way. They approximately follow the familiar second-order Cassini ovals about the two inner electrodes. Ions can be injected into the interior of the Cassini ion trap through an introductory slit (36) in the equipotential plate (38). These ions will then leave again through the exit slit (37), focused in an ideal way in terms of solid angle and energy. This reflector can also refocus ions with a broad energy spread ideally, even if the ions fly with low energy and have a relatively high energy spread.

Figure 6:
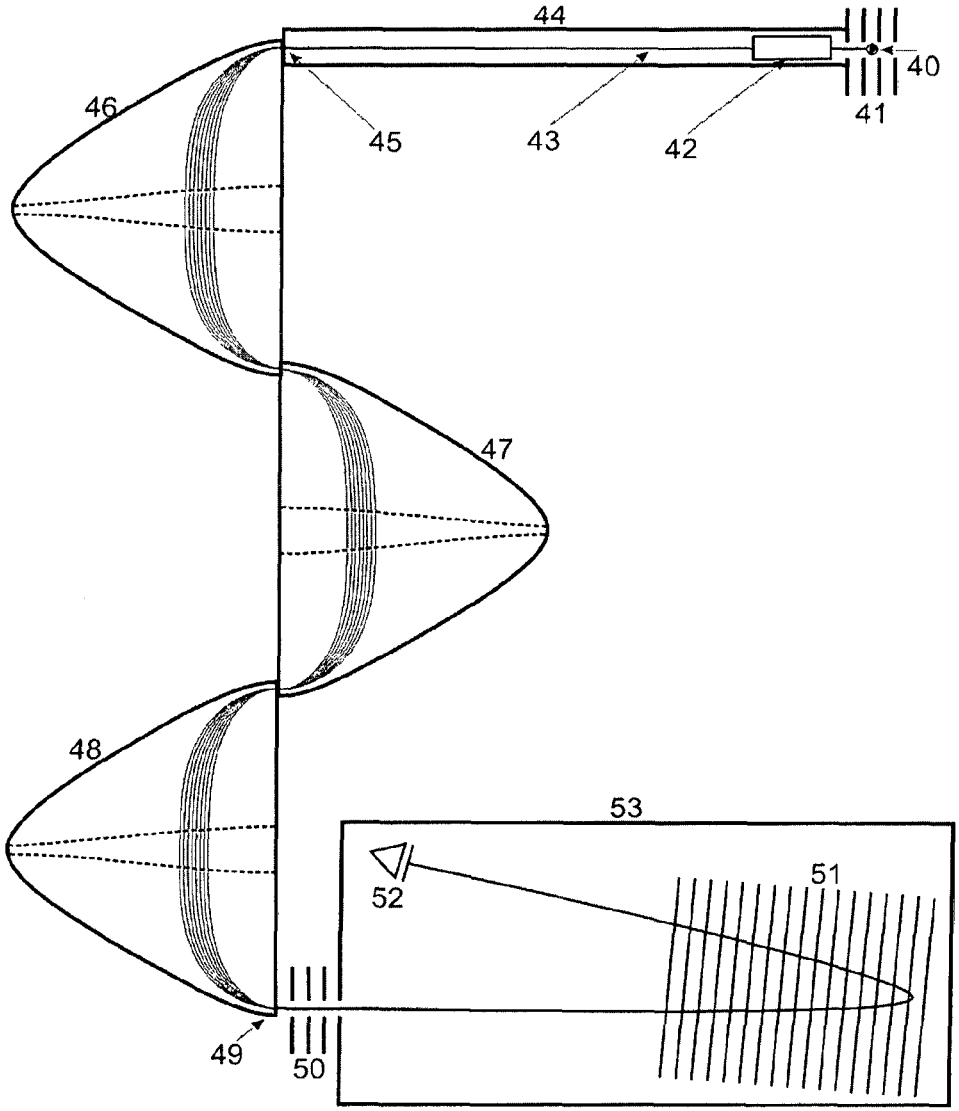

FIG. 6 depicts a time-of-flight mass spectrometer which uses three Cassini reflectors (46, 47, 48). An ion feed, not shown here, produces a fine ion beam (40), which flies into the plane of the diagram and enters the pulser (41). The fine ion beam (40) corresponds to the fine ion beam (11) in FIG. 1), and can be generated in a similar way. The pulser (41) now pulses out a small section of the ion beam (40) toward the first Cassini reflector (46). The angular offset of the ion beam (43) is corrected by a deflection capacitor (42). The outpulsing can be done at low energy, with conventional spatial and energy focusing according to Wiley and McLaren, which has its focal point at the injection point (45) ("Time-of-Flight Mass Spectrometer with Improved Resolution", W. C. Wiley and I. H. McLaren, *Rev. Sci. Instrum.*, 26, 1150 (1955)). The low-energy ions are then guided in an ideal way through the Cassini reflectors (46), (47) and (48) and refocused according to energy and solid angle at the exit (49). The ions can then be accelerated to high energies of 10 to 30 kilovolts in the acceleration unit (50) and reflected in the reflector (51) in an energy-focusing way onto the detector (52) within the housing (53), which is at a high voltage.

Figure 7:
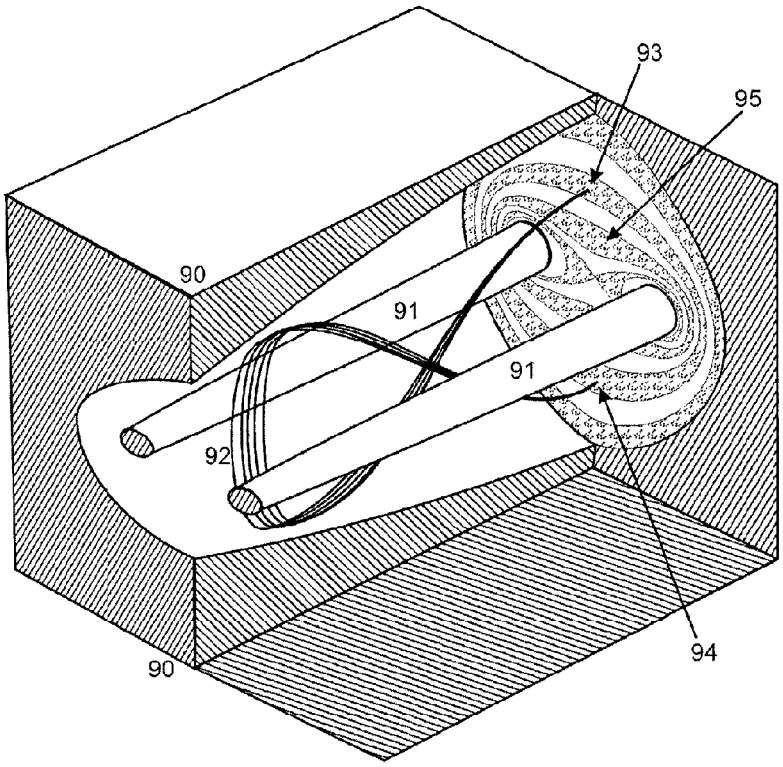

FIG. 7 represents a view into a Cassini reflector which is designed, and whose injection and ejection openings are positioned, in such a way that the ions execute precisely one and a half transverse oscillations in the reflector during the longitudinal half oscillation. The equipotential plate (95) with the printed electrodes obviates the need for the second half-space and allows the ions to be injected and ejected through this plate. The ions injected through the injection aperture (93) fly on trajectories (92) and are focused in an ideal way onto the ejection aperture (94), while ions of the same mass are focused in terms of time and solid angle in relation to both their energy spread and their angular spreads in both lateral directions. The greater penetration depth of the ions compared to the arrangement in FIG. 5 allows a significantly wider relative spread of the ion injection energies than the arrangement according to FIG. 5.

Figure 8:
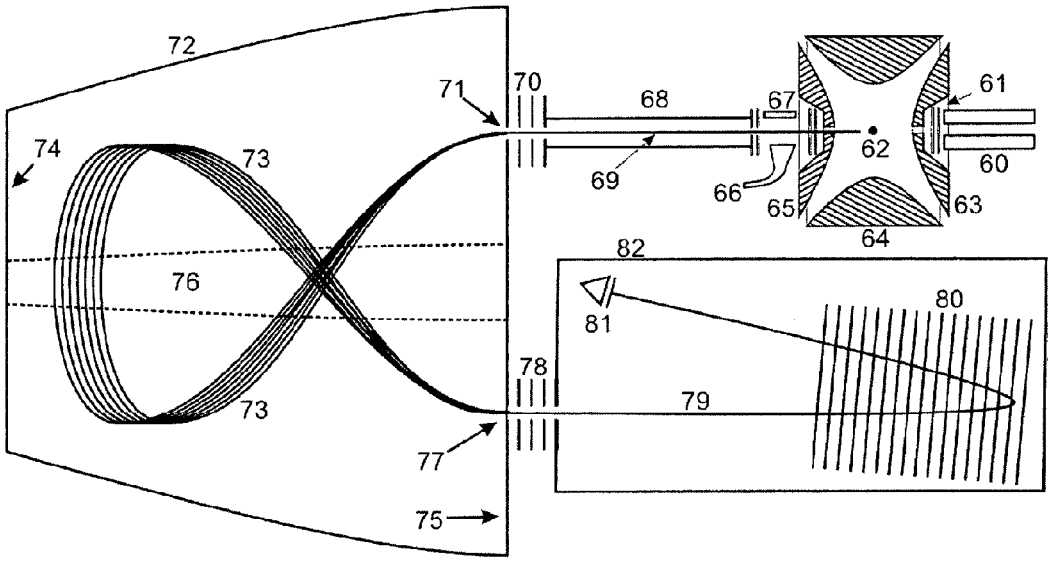

FIG. 8 represents a time-of-flight mass spectrometer which first collects the ions in an RF quadrupole Paul ion trap and cools them to form a tiny cloud (62). The ions are fed to the ion trap with end cap electrodes (63, 65) and ring electrode (64) via an RF quadrupole ion guide (60) and an ion lens (61), and are cooled there by a damping gas. The ions can be mass selectively ejected in the usual way and measured as a mass spectrum in a channeltron electron multiplier (66) via an ion electron converter (67). But the ions of the ion cloud (62) can also be simultaneously accelerated and pulsed out into an essentially field-free flight path (68), decelerated again in the diaphragm system (70), and fed to the Cassini reflector (72) at low energy with ideal angle and energy focusing at the injection location (71). The Cassini reflector is terminated at both the front and the back with equipotential plates (75) and (74) respectively. The equipotential plates (75) and (74) are coated with fine conductive tracks, which reproduce the equipotential surfaces, and are supplied with the correct potentials in order to maintain the Cassini potential. The ions leaving the exit aperture (77) are post-accelerated in the diaphragm system (78) with 10 to 30 kilovolts and reflected onto the ion detector (81) in the reflector (80) so as to focus the energy.

Figure 9:
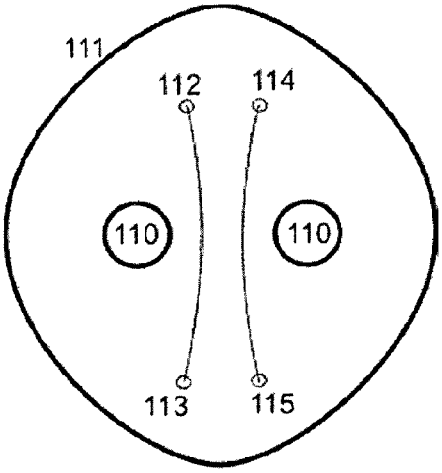

FIG. 9 illustrates how ion beams are injected through apertures (112, 114) in the equipotential plate (111) outside of the center plane, and leave again through apertures (113, 115), focused according to energy and solid angle, outside the center plane.

Figure 10:
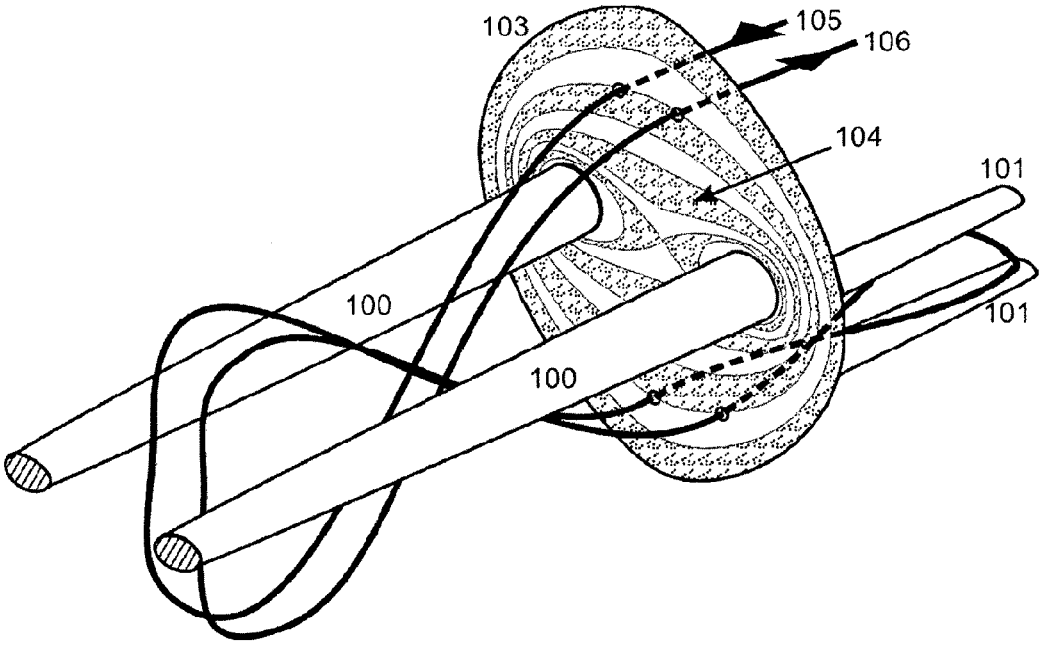

FIG. 10 shows how this behavior can be used for a double passage. The beam (105) enters through the equipotential plate (103), is reflected between the two inner electrodes (100) of the first Cassini reflector, exits again, is reflected between two further inner electrodes (101) of a second Cassini reflector, re-enters through the equipotential plate (103), is again reflected between the inner electrodes (100) of the first Cassini reflector, and re-emerges as a beam (106).

Figure 11:
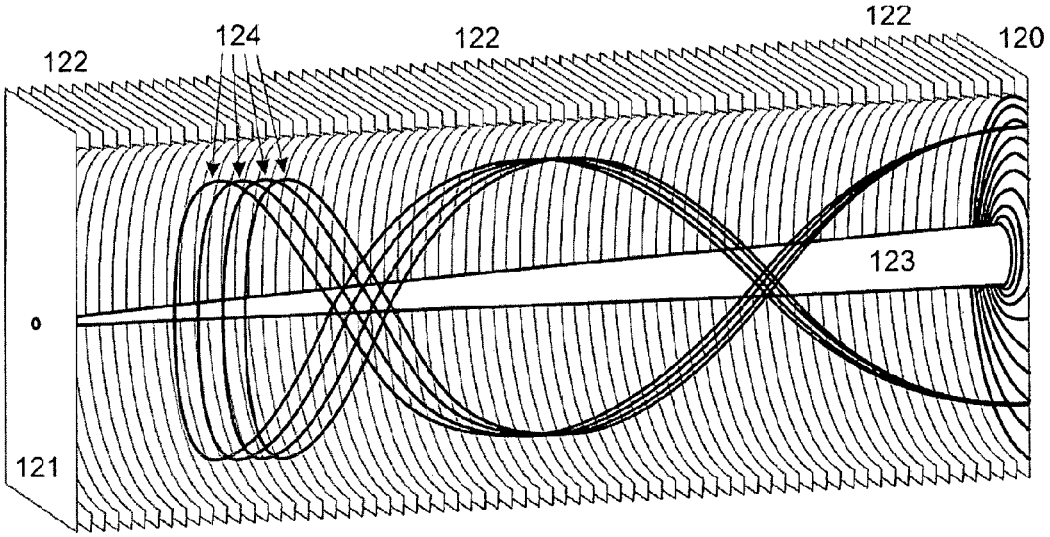

FIG. 11 shows a Cassini reflector of a different design but with the same electric field: The outer housing here is replaced by a stack of identical apertured diaphragms (122). The apertured diaphragms have inner openings in the form of a Cassini oval. In order to maintain the electric field of a Cassini ion trap, the apertured diaphragms are supplied with a quadratically increasing potential from the direction of the equipotential plate (120). The equipotential plates (120) and (121) correspond to those in FIG. 7. Ions of the same mass but different energies fly on trajectories (124) which penetrate into the reflector to different depths but which all have precisely the same time of flight.

DETAILED DESCRIPTION

The invention provides reflectors with ideal energy and angle focusing, based on the electric fields in Cassini ion traps, and particularly proposes that a section of the flight path of a time-of-flight mass spectrometer takes the form of a Cassini reflector. It is particularly favorable to make the ions fly through this Cassini reflector at relatively low energies, with kinetic energies as far below one kiloelectronvolt as possible. This results in a long mass-dispersive passage time in addition to the time of flight of the other flight paths, without increasing the energy spread $\Delta E$, the angular spreads $\Delta\phi_x$ and $\Delta\phi_y$ of the ions, or their temporal distribution width $\Delta t$, which they have acquired in the previous section of the flight path of the time-of-flight mass spectrometer. The time of flight of a singly charged ion of mass 500 Da in one of the Cassini reflectors according to the invention preferably amounts to between 10 μs and 100 ms, in particular between 100 μs and 10 ms, most preferably around 1 ms. The time-of-flight resolution of the ions and their mass resolution increase in line with the passage time. It is also possible to place several Cassini reflectors in series. The diameter and length of a Cassini reflector can be more than 75 and 100 cm respectively.

The following embodiments of Cassini reflectors and time-of-flight mass spectrometers represent examples which by no means exhaust the different designs and application possibilities of Cassini reflectors in time-of-flight mass spectrometers. They should therefore not have a limiting effect.

FIG. 6 depicts, by way of example, one embodiment of a time-of-flight mass spectrometer which operates with an orthogonally accelerated ion beam, as is the case in an OTOF-MS, and uses three Cassini reflectors. A pulser (41) injects a fine ion beam (40), as in conventional OTOF mass spectrometers, into a largely field-free flight path (44) and focuses the new ion beam (43), after a directional correction in the deflection capacitor (42), in the usual way onto the entrance slit (45) of the first Cassini reflector (46). Ions of the same mass enter the first Cassini reflector temporally focused, with the time distribution width $\Delta t_1$ usual for such pulsers, but also with an energy spread $\Delta E$ and angular spreads $\Delta\phi_x$ and $\Delta\phi_y$. They then fly through the three Cassini reflectors (46), (47) and (48), without increasing the time distribution width $\Delta t_1$, the energy spread $\Delta E$ or the angular spreads $\Delta\phi_x$ and $\Delta\phi_y$. After exiting the third Cassini reflector, the ions can then be post-accelerated to 10 to 30 kilovolts, for example in a diaphragm stack (50), reflected with energy focusing in the reflector (51), and measured in the detector (52). This brings about a further time distribution width $\Delta t_2$ in the non-ideal reflector (52). Another possible option (not shown in FIG. 6) is for the ions to be highly accelerated to 10 to 30 kilovolts over a short distance after they have exited and then impact directly onto a detector.

The time of flight through the reflector, or series of reflectors, can be several hundred microseconds; with spatially large reflectors (diameter: 150 cm, length: 200 cm) and very low kinetic energies it can even be milliseconds. This severely limits the repetition rate for the mass spectra, and the sensitivity and dynamic measuring range decrease. However, since the high mass resolution means that the mass spectra are largely empty, a temporal overlapping of the time-of-flight spectra can be tolerated, and the assignment of the individual time-of-flight peaks to the acceleration pulses of the pulser can be determined from the shape of the peaks, particularly their width, and the shape of their isotope groups (cf. DE 102 47 895 B4, J. Franzen 2002, corresponding to GB 2 396 957 B or U.S. Pat. No. 6,861,645 B2).

The Cassini reflectors (46), (47) and (48) according to the invention are of the type depicted in FIG. 5 in a three-dimensional representation. It corresponds to half a Cassini ion trap according to C. Köster (reference above), with the special feature that the ions require the same oscillation time between injection and ejection in the longitudinal direction as in the transverse direction. This means that the ions can form closed loops, as illustrated in more detail in FIG. 3, when they oscillate in the plane between the inner electrodes. The half Kingdon ion trap is terminated by a plate (38), which is called "equipotential plate" here for reasons of simplicity. Narrow, line-shaped electrodes (39) on the equipotential plate maintain the potential in the half Kingdon ion trap as it would be present in the full Kingdon ion trap. The line-shaped electrodes (39) advantageously reproduce the equipotential surfaces for this purpose. In addition, they might be supplied with voltages which correspond to the potentials in the Kingdon ion trap. The equipotential plate with the line-shaped electrodes can take the form of an electronic circuit board, for example, where the resistors which are required as voltage dividers for generating the correct voltages are mounted on the rear. The electrodes can also be printed on an insulator, such as a thin ceramic plate, in which case it is particularly favorable if the insulator is given a very high-resistance coating before the printing takes place in order to prevent it being charged by scattered ions when it is in operation. The high-resistance coating can even take the form of a voltage divider for the Cassini potentials.

The back side of the equipotential plate is covered with a single electrode plate which is held on the exact potential of the injection and ejection apertures (36) and (37) respectively. Both apertures necessarily are positioned on the same equipotential surface of the reflector. Particularly, the apertures may have the shape of slits, the slits are arranged along an equipotential surface line.

In such a Cassini reflector, ions of the same mass which enter through the slit aperture (36) in the equipotential plate (38) with a time smearing $\Delta t$, an energy spread $\Delta E$ and lateral angular spreads $\Delta\phi_x$ and $\Delta\phi_y$, are focused exactly in time t and the lateral angles $\phi_x$ and $\phi_y$ onto the exit aperture (37), while maintaining the time smearing $\Delta t$, the energy spread $\Delta E$ and the lateral angular spreads $\Delta\phi_x$ and $\Delta\phi_y$.

In the Cassini ion trap, a so-called hyperlogarithmic field is present with a potential distribution $\phi(x,y,z)$ which is mentioned here for the purpose of completeness:

$$\psi(x, y, z) = \ln\left[\frac{(x^2+y^2)^2 - 2\cdot b^2\cdot(x^2-y^2) + b^4}{ab^4}\right].$$

-continued $$\frac{U_{ln}}{C_{ln}} + [-(1-B)\cdot x^2 - B\cdot y^2 + z^2]\cdot\frac{U_{quad}}{C_{quad}} + U_{off}$$

The shape of the field can be changed by the constants a, b and B. $U_{ln}$, $U_{quad}$ and $U_{off}$ are potential voltages. The inner surface of the outer housing and the outer surfaces of the inner electrodes are equipotential surfaces $\phi(x,y,z)$=const. of this potential distribution.

As stated, FIG. 5 depicts half a Cassini ion trap, in which the lateral and the longitudinal oscillation periods are exactly equal for the given injection and ejection apertures. It is also possible to set up and use other integer ratios of the oscillation periods. FIG. 7 depicts a Cassini reflector based on half a Cassini ion trap in which the ions execute precisely one and a half lateral oscillations during half a longitudinal oscillation. When ions are injected here through the entrance aperture (93) in the equipotential plate (95), they are focused precisely onto the exit aperture (94) after half an oscillation period in the parabolic longitudinal field, again with ideal energy and solid angle focusing. Since the penetration depth of the ion trajectories (92) into the parabolic longitudinal field is much greater here than in the embodiment according to FIG. 5, a broader distribution of the ion injection energy is also possible. The acceptance of a broader, relative spread of energies in turn makes it possible to decrease the average energy and thus extend the mass-dispersive time of flight.

FIG. 8 illustrates how such a longer Cassini reflector (72), with the injection of ions from an RF Paul ion trap, is coupled to a time-of-flight mass spectrometer. In the time-of-flight mass spectrometer of FIG. 8, the ions are collected initially in an RF quadrupole Paul ion trap and cooled by a damping gas to form a tiny cloud (62). In a first operating mode, which corresponds to that of a conventional three-dimensional RF quadrupole ion trap, the ions can be mass-selectively ejected in the usual way and measured as a mass spectrum in a channeltron electron multiplier (66) via an ion electron converter (67). For many applications, however, this way of acquiring the mass spectrum does not have a sufficiently high mass resolution and mass accuracy. In a second operating mode, the ions of the ion cloud (62) can also be simultaneously accelerated and pulsed out into an essentially field-free flight path (68), decelerated again in the diaphragm stack (70), and fed to the Cassini reflector (72) at low energy with the best possible solid angle and energy focusing at the injection location (71). The Cassini reflector here is terminated at both the front and the back with equipotential plates (75) and (74) respectively. As has already been described above, the equipotential plates (75) and (74) are coated with fine conductive tracks, which reproduce the Cassini oval of the equipotential surfaces and, when supplied with the correct voltages, maintain the Cassini potential. The ions leaving the exit aperture (77) are post-accelerated in the diaphragm system (78) with 10 to 30 kilovolts and reflected onto the ion detector (81) in the reflector (80) so as to focus the energy. This second operating mode of the arrangement from FIG. 8 provides a very high mass resolution and a very high mass accuracy, as a high-quality time-of-flight mass spectrometer.

The ions do not have to fly through a second reflector (80), however. After a post-acceleration in the diaphragm system (78), they can impact perfectly perpendicularly onto an ion-electron converter plate and release secondary electrons there. The electrons are accelerated backwards in the diaphragm system (78), re-enter the Cassini reflector via the aperture (77), pass through the reflector with their high energy, leave again through a further aperture (not shown in FIG. 8), and can then be detected in a normal secondary electron multiplier. This combination of a Cassini reflector with a high-quality ion detector has several advantages compared to conventional ion detectors; in particular it causes no additional time smearing of the signals, as occurs in multichannel plate secondary electron multipliers, for example.

Instead of the RF quadrupole ion trap, a time-of-flight mass spectrometer similar to the one shown in FIG. 8 can also be equipped with a MALDI ion source. The analyte ions are then produced in a plasma, which is generated by laser bombardment of the sample containing the analyte substance, and are then accelerated with a temporal delay, which leads to a temporal focusing of ions of the same mass at the entrance aperture (71) of the Cassini reflector of FIG. 8, if the delay time and the acceleration field strength are set correctly. This arrangement offers special advantages for the mass spectrometric analysis of fragment ions. Ions which decay in the field-free space in front of the Cassini reflector are spatially and temporally focused in this reflector, regardless of the change in kinetic energy compared to the mother ion. Additional elements, which are necessary in conventional reflector systems to accelerate the fragment ions in a special way, are not required.

It is also possible to build Cassini reflectors which are even slimmer and which penetrate to greater depths into the parabolic potential in the longitudinal direction. The ions may then execute 5/2, 7/2 or 9/2 transverse oscillations per half a longitudinal oscillation. This increases the acceptance for ions with a broad relative energy spread.

Furthermore, it is not necessary to inject the ions in the center plane of the Cassini reflector in order for them to be ideally reflected. FIG. 9 shows how an ion beam enters away from the center plane, and also exits again away from the center plane, ideally focused according to energy and solid angle. This behavior can also be used for a double passage of a Cassini reflector. FIG. 10 shows such an arrangement. If the penetration depth of the ion beam into the first Cassini reflector is around one meter, the entrance beam (105) and exit beam (106) can quite easily be around six centimeters apart. It is thus possible to make heavy ions with a molecular weight of 3000 daltons from an RF quadrupole ion trap pass through a mass-dispersive time of flight of a few milliseconds. The time-of-flight spectrum can be measured with 400 million measurements per second using a 16-bit ADC, and produces resolutions of R>100 000 in the medium mass range.

The housing of the Cassini reflectors according to FIGS. 5 to 7 is not very easy to manufacture. Additionally, the interior of the largely closed Cassini reflectors is not easy to evacuate. FIG. 11 therefore shows a Cassini reflector of a completely different embodiment, but with the same electric field. The outer housing here is replaced by a stack of identical apertured diaphragms (122), as are used in a similar design according to the prior art for Mamyrin reflectors. The apertured diaphragms here have inner openings in the form of a Cassini oval, however. In order to maintain the electric field of a Cassini ion trap, the apertured diaphragms are supplied with a quadratically increasing potential from the direction of the equipotential plate (120). The equipotential plates (120) and (121) correspond to those in FIG. 7. Ions of different energies fly on trajectories (124) which extend to different depths into the reflector, but all have precisely the same time of flight for ions of the same mass. This embodiment has several advantages: the reflector is easier to evacuate; the overall size is smaller, the manufacture is simpler and lower cost.

It shall be mentioned that the inner electrodes can also be assembled as stacks of identical diaphragms, which may be supplied with a quadratically decreasing potential. The manufacture is possibly more complicated than the manufacture of compact inner electrodes, however.

The person skilled in the art will find it easy to develop further interesting embodiments based on the devices for the reflection of ions according to the invention. The part which is subject to this invention shall also be covered by this patent protection application.

The invention claimed is:

1. A time-of-flight mass spectrometer having an ion source, a flight path, a single reflector with a potential distribution of a Cassini ion trap within the flight path, and an ion detector, wherein the single reflector is one halved Cassini ion trap with a housing, several inner electrodes and a terminating equipotential plate with electrodes, the electrodes of the equipotential plate trace equipotential surfaces of the potential distribution of the Cassini ion trap at a location of the equipotential plate.

2. The time-of-flight mass spectrometer according to claim 1, wherein the equipotential plate has apertures for an injection of ions and an ejection of ions.

3. The time-of-flight mass spectrometer according to claim 2, wherein a shape of the reflector and a positions of the injection and ejection apertures are designed so that ions of the same mass pass through an odd whole number of transverse half oscillations in the reflector during a half longitudinal oscillation.

4. The time-of-flight mass spectrometer according to claim 2, wherein the injection and ejection apertures have the shape of slits.

5. The time-of-flight mass spectrometer according to claim 1, wherein the housing of the reflector is constructed as a stack of identical apertured diaphragms, with a voltage supply which generates a potential that increases quadratically from diaphragm to diaphragm.

6. The time-of-flight mass spectrometer according to claim 1, wherein at least one diaphragm system is present accelerating or decelerating ions in such a way that the ions pass through the reflector with a kinetic energy of less than two kiloelectronvolts.

7. The time-of-flight mass spectrometer according to claim 1, wherein the time-of-flight mass spectrometer includes a pulser for an orthogonal injection of a fine ion beam.

8. The time-of-flight mass spectrometer according to claim 1, wherein the time-of-flight mass spectrometer includes an RF quadrupole ion trap.

9. The time-of-flight mass spectrometer according to claim 1, wherein an ion acceleration system with a conversion plate is mounted at an exit of the reflector; the conversion plate converts ions into electrons, which then fly backwards through the reflector with a high energy; and a secondary electron multiplier for detecting the electrons is mounted behind the equipotential plate.

10. A time-of-flight mass spectrometer having an ion source, a flight path, multiple reflectors within the flight path, and an ion detector, wherein each reflector comprises one halved Cassini ion trap with a housing, several inner electrodes and a terminating equipotential plate comprising an injection aperture, an ejection aperture and electrodes, the electrodes of the equipotential plate trace equipotential surfaces of a potential distribution of the Cassini ion trap at the location of the equipotential plate, and wherein the halved Cassini traps are shifted to each other with regard to the longitudinal direction such that the ejection aperture of a preceding reflector is aligned to the injection aperture of a subsequent reflector.

11. A time-of-flight mass spectrometer having an ion source, a flight path, a reflector inside the flight path and an ion detector, wherein the reflector is a Cassini ion trap with first and second housings and two inner electrodes, the second housing being smaller than the first housing and supplied with a lower voltage difference to the inner electrodes than that of the first housing so that electric fields in the interior of the Cassini ion trap are maintained, and wherein the reflector comprises an ion injection point and an ion exit point, the points being at an interface of the two housings such that ions travel for a half longitudinal oscillation in the interior of the first housing and are transferred from the injection point to the exit point.

* * * * *